US008564201B2

(12) United States Patent
Rooijackers

(10) Patent No.: US 8,564,201 B2
(45) Date of Patent: Oct. 22, 2013

(54) AMALGAM-BASED FLUORESCENT LAMP CONTROL CIRCUIT

(75) Inventor: Cornelis Jozef Petrus Maria Rooijackers, Waalre (NL)

(73) Assignee: NXP B.V., Eindhoven (NL)

( * ) Notice: Subject to any disclaimer, the term of this patent is extended or adjusted under 35 U.S.C. 154(b) by 368 days.

(21) Appl. No.: 12/940,475

(22) Filed: Nov. 5, 2010

(65) Prior Publication Data

US 2012/0112637 A1 May 10, 2012

(51) Int. Cl.

| | |
|---|---|
| ***H01J 17/20*** | (2012.01) |
| ***H01J 61/20*** | (2006.01) |
| ***H01J 63/04*** | (2006.01) |
| ***H01J 1/62*** | (2006.01) |
| ***H01J 7/24*** | (2006.01) |
| ***H01J 13/32*** | (2006.01) |
| ***H01J 17/28*** | (2006.01) |
| ***H01J 19/74*** | (2006.01) |
| ***H01J 61/52*** | (2006.01) |

(52) U.S. Cl.

USPC ..... 313/639; 313/493; 315/117

(58) Field of Classification Search

None

See application file for complete search history.

(56) References Cited

U.S. PATENT DOCUMENTS

| | | | | |
|---|---|---|---|---|
| 5,739,633 | A * | 4/1998 | Biro et al. | 313/490 |
| 5,952,780 | A | 9/1999 | Forsdyke et al. | |
| 6,476,553 | B1 | 11/2002 | Iida et al. | |
| 2006/0273724 | A1 * | 12/2006 | Kwong | 313/634 |
| 2011/0298356 | A1 * | 12/2011 | Lucz et al. | 313/490 |

FOREIGN PATENT DOCUMENTS

| | | | | |
|---|---|---|---|---|
| JP | 61227358 | A * | 10/1986 | H01J 61/28 |

* cited by examiner

*Primary Examiner* — Douglas W Owens
*Assistant Examiner* — Dedei K Hammond

(57) ABSTRACT

A lamp is operated with main and auxiliary amalgams. In accordance with one or more embodiments, a lamp includes an auxiliary amalgam-based material that releases mercury at an elevated temperature that is above an operating temperature of the lamp, and that absorbs mercury at temperatures below the elevated temperature. During a start-up period, the auxiliary amalgam-based material is heated to cause the material to release mercury for generating light in the lamp. After the start-up period, the auxiliary amalgam-based material is allowed to cool below the elevated temperature and absorb mercury, while the lamp continues to operate for generating light using a main amalgam.

15 Claims, 7 Drawing Sheets

AMALGAM-BASED FLUORESCENT LAMP CONTROL CIRCUIT

Aspects of various embodiments of the present invention are directed to amalgam-based fluorescent lamps, and more particularly to lamp control circuits.

Light sources such as lamps are used in a multitude of applications, ranging from relatively simple applications for providing ambient light, to more complex applications such as those involving the illumination of displays. While light sources have seen increasing use for a variety of applications, one application that has seen particular growth involves the use of fluorescent lights, such as compact fluorescent lights (CFLs), for replacement of incandescent light bulbs and other applications.

A variety of different types of light sources are used to suit different applications. For example, fluorescent light sources such as CFLs have been used for a variety of different types of illumination purposes. CFL light sources generate light by exciting a gas or vapor that is enclosed in a tube, controlled by a magnetic or electronic ballast. CFLs containing liquid mercury spill this mercury in the environment when broken or (unprofessionally) disposed of. Amalgam-based CFLs have this problem to a much lesser extent, and have therefore gained in popularity.

While amalgam based CFLs have been useful, their implementation has been challenging for applications in which a rapid turn-on time is desired. For example, amalgam CFLs often exhibit undesirably long run-up times, which is the time it takes for the lamps to produce full light output. For amalgam based CFLs, only containing main Amalgam in the tube, the light output in the first 3-5 minutes is often too low. Some Amalgam based CFLs have employed auxiliary amalgams, usually located near electrodes, to provide additional mercury release, to provide a much better response upon powering on if the lamp has previously been switched on (and then off) within a few hours (e.g., within less than about 6-15 hours). For example, it can take up to 15 hours for mercury to return to an (auxiliary or other) amalgam after the lamp has been switch off.

These and other matters have presented challenges to the design and implementation of amalgam based lamps for a variety of applications.

Various example embodiments are directed to lamp circuits, devices and their implementation.

In connection with an example embodiment, a lamp circuit includes a heater and a driver circuit (e.g., in addition to or as part of a ballast circuit), to facilitate the generation of light soon after the light is turned on. The heater is driven, or controlled, by the driver circuit to heat a nearby auxiliary amalgam-based material in a lamp tube containing an auxiliary amalgam-based material and a main amalgam-based material. The driver circuit controls the heater, during a start-up period, to heat the auxiliary amalgam-based material to an elevated temperature at which the auxiliary amalgam-based material releases mercury. After the start-up period, the driver circuit controls the heater to permit the auxiliary amalgam-based material to drop to a temperature at which the auxiliary amalgam-based material absorbs mercury (e.g., by turning a portion of the heater off), while the main amalgam-based material is heated to a lamp operating temperature at which the main amalgam-based material releases mercury. This heating may be effected, for example, by discharge current in the lamp, and may also be assisted by the heater.

Another example embodiment is directed to a lamp circuit having a heating circuit, main and auxiliary amalgam-based materials, and a driver circuit. The main amalgam-based material releases mercury at a lamp operating temperature. The auxiliary amalgam-based material is located near the heating circuit, releases mercury at an elevated temperature that is above the lamp operating temperature, and absorbs mercury at temperatures below the elevated temperature. The driver circuit drives a filament, or electrode, to generate light and at the same time heat the lamp and with it its main amalgam-based material to the lamp operating temperature and causes the main amalgam-based material to release mercury. During a start-up period, the driver circuit drives a heating circuit to heat the auxiliary amalgam-based material to the elevated temperature and causes the auxiliary amalgam-based material to release mercury. In various embodiments, the heating circuit is included with, or part of, the filament or electrode. In some embodiments, one or more additional auxiliary amalgams are located near the filament/electrode, and may employ an amalgam that does not re-absorb mercury until long after the lamp circuit is switched off.

Another example embodiment is directed to a method for operating a lamp circuit. During a start-up period, a heater is driven to heat a nearby auxiliary amalgam-based material to an elevated temperature at which the mercury is released into a lamp tube containing the auxiliary amalgam-based material and a main amalgam-based material. This elevated temperature may, for example, correspond to a temperature at which the auxiliary amalgam-based material releases a large percentage (e.g., 50%) of its mercury. After the start-up period, the heater is driven (e.g., in a reduced mode, or turned off) to permit the auxiliary amalgam-based material to drop to a temperature at which the auxiliary amalgam-based material re-absorbs mercury, while the main amalgam-based material is heated to a lamp operating temperature at which the main amalgam-based material releases mercury. In many implementations, this approach involving the re-absorption of mercury is used to ensure that, after an off/on cycle, there is sufficient mercury present for release and illumination, generally regardless of how much time the lamp was on or off.

The above discussion/summary is not intended to describe each embodiment or every implementation of the present disclosure. The figures and detailed description that follow also exemplify various embodiments.

Various example embodiments may be more completely understood in consideration of the following detailed description in connection with the accompanying drawings, in which.

Figure 1:
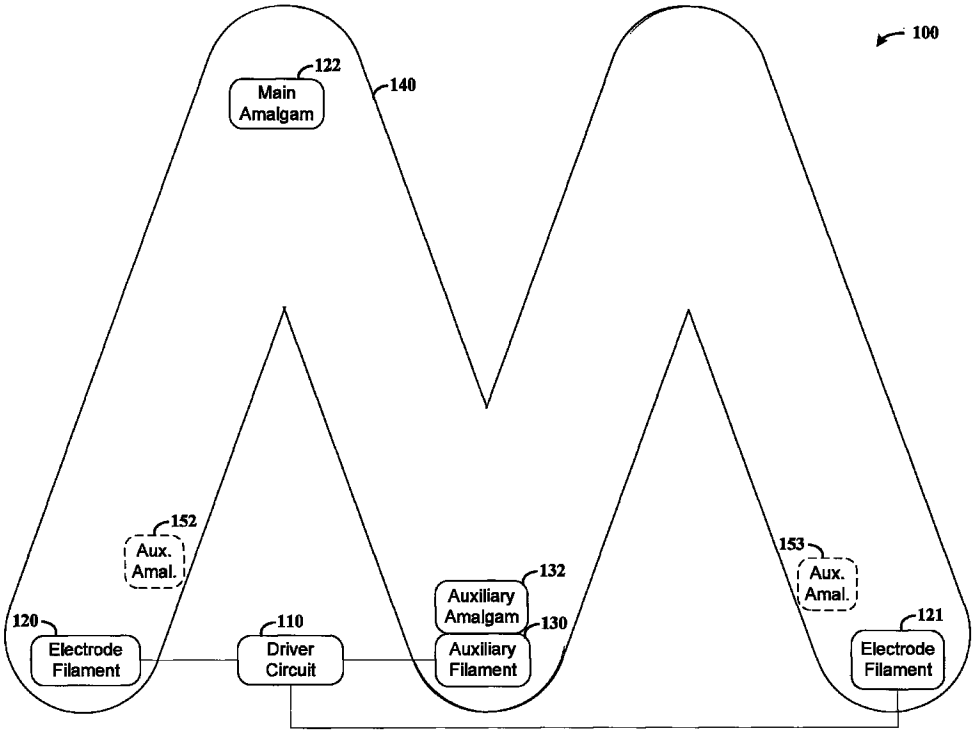
FIG. 1 is a block diagram of a lamp circuit including a driver circuit and an auxiliary amalgam, according to an example embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the invention including aspects defined in the claims. In addition, the term "example" as used throughout this application is only by way of illustration, and not limitation.

Aspects of the present invention are believed to be applicable to a variety of different types of devices, systems and arrangements, including those involving lamps and lamp circuits, such as driver circuits that operate amalgam-based lamps, circuits employing such driver circuits, and to a larger system such as a lamp system or a display employing such circuits. While the present invention is not necessarily so limited, various aspects of the invention may be appreciated through a discussion of examples using this context.

In accordance with various example embodiments, a method for operating a lamp includes controlling the release of mercury from a reservoir/auxiliary amalgam-based material into a lamp tube during a start-up condition of the lamp, to provide mercury for use in generating light (e.g., in the first few seconds of lamp operation). In some implementations, this auxiliary mercury release is coupled with the application of a discharge current boost to the tube, which causes the lamp to heat at a relatively fast rate. The increased heating causes the lamp to release its main amalgam mercury more quickly, and correspondingly to generate additional light via a higher mercury excitation rate. The auxiliary amalgam is heated using, for example, a heating circuit that heats the amalgam-based material (and may do so in response to the current boost).

The heating circuit may, for example, include a filament, inductive coil or other heating device that heats the auxiliary amalgam-based material to release mercury. In some implementations, the auxiliary amalgam-based material is configured to release mercury at an elevated temperature that is above a nominal working temperature of the lamp (e.g., at which a main amalgam material releases mercury), and is further configured to re-absorb the mercury below the elevated temperature, such as at the nominal working temperature of the lamp.

Other example embodiments are directed to a lamp driver circuit that controls both an amalgam heater and two discharge electrodes for a lamp as discussed above. The driver circuit controls the amalgam heater to heat an auxiliary amalgam-based material and cause the material to release mercury into a lamp tube. The driver circuit also applies a current to preheat the electrode to reach a high enough temperature at which ignition can take place without significant damage to the electrodes. This preheat stage heats the discharge electrodes and, with that, causes the release of mercury from nearby (e.g., additional auxiliary) amalgam-based material, if mercury is present in the amalgam-based materials (e.g., if the lamp has not been on for many hours prior to switching on). The discharge electrodes are driven to emit electrons from one to the other electrode through the lamp tube, for generating light from the released mercury when this mercury is hit by the electrons.

In connection with other example embodiments, an amalgam-based lamp circuit includes an auxiliary amalgam-based material, a heating filament for heating the auxiliary amalgam-based material, and a driver circuit that applies current to the filament to heat the auxiliary amalgam-based material. The filament is driven at a high temperature during a startup period in which the auxiliary amalgam-based material is used to release mercury. After this startup period, the lamp circuit continues to operate nominal lamp operating temperature, relative to the startup period, via the generation of light using mercury released from a main amalgam-based material and further during which the auxiliary amalgam near the heating filament absorbs mercury. Any auxiliary amalgam (if any) near the electrode filaments generally do not cool down during lamp operation as the electrode filaments operate at high temperature for proper lamp operation (e.g., for a CFL).

The amalgam-based lamp circuit includes two main filaments or electrodes, which generate light via electron emission and while doing so, heat the lamp and the lamp's main amalgam-based material to its nominal operating temperature. The driver circuit may also be implemented to control the main filament discharge current. In certain implementations, the driver circuit (or another control circuit) is used to apply a current boost to the main filaments/electrodes in connection with the startup period, to rapidly heat the lamp and the lamp's main amalgam-based material and generate a high level of electrons, or discharge current, relative to normal lamp operation (e.g., after the boost and startup periods).

A current boost as discussed herein may involve, for example, a boost in current of between about 50-100% of normal operational current for the lamp, as applied to the electrodes used to generate a discharge current and heat the lamp (and therein heat a main amalgam-based material). The timing of the boost can also vary depending upon the application, and in many implementations is applied within the first 1-2 minutes of start-up of the lamp. For certain applications, the application of the boost is controlled relative to a previous turn-off time of the lamp, such as in response to a lamp having been operated in an on state within several hours. Such a boost may, for example, be carried out in connection with a startup period as discussed above, in which an auxiliary amalgam material is heated to generate mercury and subsequently cooled for normal operation. This additional mercury is used to facilitate the boost, such that the additional discharge current has more mercury via which to generate light. In some embodiments, the (e.g., silicon) temperature of a controller itself or a temperature sensing device (such as a PTC/NTC thermistor) is used to determine if the lamp has been on within a particular time period (e.g., the last 5 minutes), and control the start-up of the lamp accordingly.

A variety of different types of auxiliary/reservoir amalgam-based materials and related arrangements can be used to suit particular applications. For general information regarding such materials and arrangements, and for specific information regarding amalgam-based materials and related circuits that may be implemented in connection with one or more example embodiments, reference may be made to U.S. Pat. Nos. 5,739,633 and 6,476,553, which are fully incorporated herein by reference.

With respect to amalgam-based materials, a variety of materials may be used, including amalgam compounds exhibiting a relatively high working temperature. As consistent with various embodiments discussed herein, an amalgam-based material is an alloy of mercury and one or more other metals. In many implementations, an amalgam-based material that exhibits a relatively low mercury pressure during lamp operation is used and positioned relative to a heating circuit to achieve operation as discussed herein. The amalgam releases mercury when heated to a point corresponding to the particular material's mercury release temperature, and absorbs mercury below this temperature. Relative to an auxiliary amalgam-based material as discussed herein, such a material may be selected in composition to release mercury during a start-up period (which may be combined with an electrode boost), and absorb mercury during normal temperature operation of the lamp (e.g., a temperature at which a main amalgam continues to release mercury). For general information regarding amalgam materials, and for specific information regarding materials that may be used in accordance with one or more example embodiments (e.g., with an appropriate filament and amalgam placement), reference may be made to U.S. Pat. No. 5,952,780, which is incorporated herein by reference.

Similarly, a variety of filaments are used to suit different applications, to handle an appropriate level of heating to cause an amalgam to release mercury (e.g., when heating only), or to cause an amalgam to heat and also apply discharge current to generate light (e.g., when heating and operating with a main amalgam as discussed herein). For general information regarding filaments, and for particular information regarding filaments that may be used in connection with one or more example embodiments, reference may be made to U.S. Pat. No. 5,739,633 (cited above).

A more particular example embodiment is directed to a lighting circuit for general lighting or for backlighting, such as a cold-cathode compact fluorescent lamp (CCFL) used for video displays. An amalgam reservoir is used together with an auxiliary filament to heat the reservoir during initial turn-on conditions, to facilitate the release of mercury and rapidly illuminate the display while a tube and a main amalgam material in the tube heats. After an initial turn-on period and/or in conjunction with the main amalgam material illuminating the display at a full strength type of illumination, the auxiliary filament is operated to reduce and/or stop heating of the amalgam reservoir to allow the reservoir to return to a temperature below which the amalgam no longer releases mercury, and absorbs mercury for use in a subsequent turn-on cycle. In some implementations, this operation of the auxiliary filament is made in combination with the application of a boost current through the tube for generating light from the released mercury.

Heating circuits such as filaments used to heat an auxiliary amalgam as discussed herein are controlled in one or more of a variety of manners, depending upon the implementation. In one example embodiment, a lamp driver circuit operates an auxiliary filament for heating an auxiliary amalgam in stages as follows. In a first stage (e.g., at initial start-up, between 0-0.5 seconds), the auxiliary heating filament is controlled by the driver such that it is very rapidly heated in this period, during which the main filaments that operate as electrodes may also be undergoing a start-up or pre-heat condition.

The auxiliary filament is heated to a level (e.g., temperature) that is sufficient to heat the auxiliary amalgam to a point that it releases mercury to assist in the generation of light for various applications. This heating level may be set based upon conditions including the type of auxiliary amalgam, positioning of the auxiliary amalgam relative to the auxiliary filament, and the type of bulb or other arrangement in which the amalgam is located. In many implementations, the auxiliary filament is controlled to heat the auxiliary amalgam to a temperature that is above a threshold mercury-release temperature at which the amalgam releases mercury. For instance, in certain applications an auxiliary heating element is heated to about 1400K to cause an auxiliary amalgam to release mercury trapped in or otherwise included with the amalgam, to a tube for illumination.

Once the threshold temperature has been met and/or exceeded, the auxiliary filament is throttled, or otherwise controlled with a reduced power, to apply less heat to the auxiliary amalgam in a second stage. During this second stage, the amalgam is maintained at a few hundred K above its threshold mercury-release temperature to facilitate the continuing release, or for sure prevent the absorption of, mercury.

The length of this second stage can be set based upon conditions of the lamp being used, the driver and a main amalgam used to provide illumination after a start-up period has passed. For instance, if a main amalgam and electrode that generates a discharge current for light generation (and heating the main amalgam) function to provide low-level light during an initial period (e.g., 30 seconds) until the light heats up, the auxiliary filament is operated to heat the auxiliary amalgam through this time period to provide additional light to make up for the lack of light during this initial low-light period. Accordingly, the length of the second stage may, for example, range from between about 0.5-30 seconds after start-up.

In addition, while a main electrode and main amalgam may be capable of generating a threshold level of mercury to provide sufficient illumination at a relatively short time period (e.g., a few seconds), this rapid heating may be undesirable for a variety of purposes, such as for longevity of the main electrode. Accordingly, some implementations are directed to an auxiliary filament driver circuit and an auxiliary amalgam that work to provide sufficient illumination for a longer start-up period, to permit a slower start-up of a main electrode.

The throttling (or other control) of the auxiliary heating filament at the onset of the second stage can be effected in a variety of manners. In some implementations, an auxiliary driver is configured to generate a driving signal having a duty cycle that is modified (e.g., relative to the first stage) such that the auxiliary filament stays heated to a level that is sufficient to cause the auxiliary filament to release its last mercury. This throttling approach can thus be implemented so that little or no increase in temperature of the auxiliary filament is effected, or in cases in which the auxiliary filament has been heated beyond its threshold, so that the auxiliary filament may drop in temperature (but maintain sufficient heating of the auxiliary amalgam to cause the release of mercury). For instance, using the above example in which an auxiliary amalgam is heated to 1400 K, the temperature of the auxiliary filament may be dropped to about 800K, while maintaining the auxiliary amalgam at a high enough temperature such that it does not reabsorb mercury. This approach is also implemented to ensure that the auxiliary filament is not heated to a high level for a long period, to mitigate or avoid undesirable conditions that may occur with extended high-temperature heating.

In a third stage, once the main amalgam has been heated to a level at which it releases mercury sufficient for generating enough light for the particular application in which the lamp is to be used, the auxiliary filament is allowed to cool, thus cooling the auxiliary amalgam to a level at which the auxiliary amalgam re-absorbs mercury. This cooling may, for example, involve throttling an auxiliary driver circuit to provide less current to an auxiliary filament and thus cool the filament. This cooling may also involve simply turning the auxiliary filament off. This cooling is also controlled via the placement of the auxiliary amalgam, relative to the rest of the tube and including the location of the main filament (e.g., so that the main filament does not heat the auxiliary amalgam to its mercury-release threshold).

As discussed herein, driver circuits, or heating circuits, may be implemented in a variety of manners. In some embodiments, a single driver circuit and electrode are used to heat both main and auxiliary amalgams in a bulb. In other embodiments, a single driver circuit is used to drive an electrode for generating light and heating the tube and the main amalgam in the tube, and to drive a separate filament (or other heating circuit) for heating the auxiliary amalgam. In still other embodiments, a driver drives the heating of an auxiliary filament to heat the auxiliary amalgam, and a separate driver circuit operates a main electrode for generating current to illuminate the lamp and heat the main amalgam. The respective amalgams are positioned relative to the heating elements and/or electrodes as appropriate, such that the auxiliary amalgam is heated to a much higher temperature, relative to the main amalgam.

In some implementations, such a driver circuit drives the discharge current through the tube at a boost level during a startup period, which effects the generation of additional electrons for enhanced lighting during a boost period (and, which further results in the tube reaching its operating temperature more quickly, which heats the main amalgam). This boost may be carried out by, for example, lowering the frequency of a controller output that is connected to main electrodes via an inductor that is used as a frequency-dependent impedance (e.g., as in FIG. 4). The driver also drives an auxiliary filament to heat the auxiliary amalgam and cause the amalgam to release mercury, which as combined with the additional electrons emitted via the boost, results in additional light generation during the startup period. After the startup period, the driver circuit drives the current through the main electrodes at normal lamp operational level, and also drives the auxiliary filament at a lower level that allows the auxiliary amalgam to cool to a temperature at which the auxiliary amalgam absorbs mercury (for a subsequent start-up), and at which the main amalgam continues to release mercury that is used to generate light. Other embodiments are directed to the use of additional heating elements (e.g., filaments) that are positioned to effect heating of the respective amalgams as discussed herein and/or additional amalgams (e.g., that may not necessarily re-absorb mercury at normal lamp operation).

In yet another embodiment, the temperature of a lamp heater and duration of heating is configured such that only about 50% of amalgam trapped in an auxiliary amalgam as discussed herein, is released. If the lamp is switched off before the amalgam has returned to (been re-absorbed by) the auxiliary amalgam, and the lamp is subsequently switched on again 25% of the trapped amalgam will be released. If this cycle is repeated, 12.5% of the trapped amalgam can be released.

The following figures characterize various example embodiments, as may be implemented in connection with one or more of the approaches discussed above. Beginning with FIG. 1 and in accordance with one or more example embodiments, a lamp 100 includes a driver circuit 110, main electrode filaments 120 and 121, a main amalgam 122, an auxiliary filament 130 and an auxiliary amalgam 132. A tube 140 encloses the main and auxiliary amalgams 122 and 132, and holds mercury released from the amalgams for generating light (via electrons emitted by electrode filament 120 and passed to electrode filament 121). The shape of the tube 140 is exemplary, and may involve a U-shaped, L-shaped, spiral, T-shaped (containing the electrode filament in one leg and the heater plus auxiliary amalgam in the other) or linear tube, with electrodes positioned for passing current through at least a portion of the tube (e.g., as shown in FIG. 4 and/or as in the patent documents referenced herein).

The driver circuit 110 drives the auxiliary filament 130 to heat the auxiliary amalgam 132. In some implementations, the driver circuit 110 also drives the electrode filaments 120 and 121 for discharging current in the tube 140 for generating light (and also heating the main amalgam 122). Notably, while the main amalgam 122 is shown placed relative to the other components of the lamp 100, in practice a variety of locations are available for storing the main amalgam, such as along the inside of the tube 140 or in multiple locations. The actual main amalgam location can depend, for example, upon the operation of the lamp (e.g., base up or base down).

The main amalgam 122 releases mercury at a nominal working temperature of the lamp 100, and the auxiliary amalgam 132 releases mercury at an elevated start-up temperature of the lamp. The lamp 100 may thus be operated in accordance with one or more of the embodiments discussed above, including that described in connection with the flow diagram in FIG. 2 below. In one implementation, the driver circuit 110 operates the auxiliary filament 130 during a start-up period, to facilitate the release of mercury from the auxiliary amalgam 132 to provide an additional mercury source. This additional mercury release may be implemented in connection with a boost condition during which the electrode filaments 120 and 121 are driven at a high current level through the tube and boost the generation of light from mercury in the tube 140. As discussed above, the driver circuit 110 may also be implemented to operate the electrode filaments 120 and 121 during and after the boost condition, which heats the main amalgam 122 and generates light in the bulb 140. After the start-up period, the driver circuit ceases to drive the auxiliary filament 130, to permit the auxiliary amalgam 132 to cool below a temperature at which it releases mercury, and to a temperature at which mercury is re-absorbed (or absorbed) into the amalgam 132 for use in a subsequent start-up condition.

In some implementations, the driver circuit 110 drives the auxiliary filament 130 in a throttled condition after an initial rapid heating period, to reduce current supplied to the auxiliary filament yet maintain the element at a temperature that is sufficient to maintain the auxiliary amalgam 132 at a temperature at which the auxiliary amalgam releases mercury. This throttling effect may, for example, be carried out using a modified duty cycle or other approach as discussed herein.

In another embodiment, the lamp 100 also includes additional auxiliary amalgams such as one or both of amalgams 152 and 153, which may be optionally heated by another auxiliary filament. The auxiliary amalgams 152 and 153 may, for example, operate to release mercury in connection with that released by the main amalgam, and may absorb mercury (e.g., relatively slowly) after the lamp is turned off.

Figure 2:
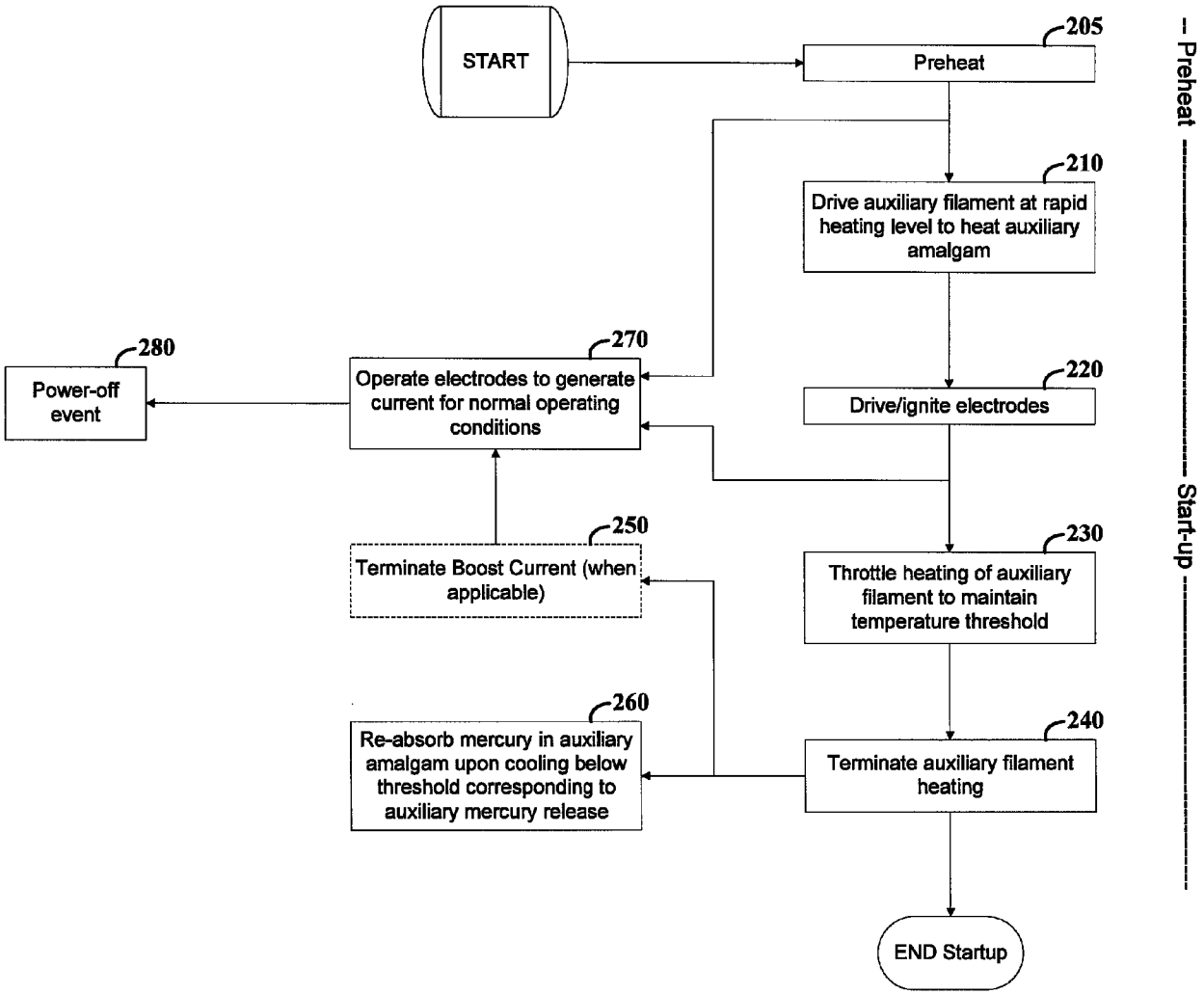
FIG. 2 shows a flow diagram for operating a lamp circuit, according to another example embodiment of the present invention.

FIG. 2 shows a flow diagram for operating a lamp circuit, according to another example embodiment of the present invention. The flow diagram shows an optional timing sequence in which the time that has passed since the last operation of the lamp circuit is tracked and used for operating the lamp circuit during start-up (e.g., which may be operable to omit start-up delay if additional mercury is not needed). In this context, the flow diagram may be implemented without this timing sequence, with the following discussion beginning with an embodiment in which the timing sequence is not used.

Prior to start-up, the lamp circuit is operated in a pre-heat condition at block 205. This pre-heat time may vary, and in some instances, involves about a 0.5 second preheat of auxiliary filaments, and may also involve a preheat of a main electrode filament (e.g., for 1 second) and any other auxiliary filaments in the lamp. At the initiation of a start-up period, at block 210, the auxiliary filament is driven at a rapid heating level to heat an auxiliary amalgam and cause the amalgam to release additional mercury. Electrode filaments in the lamp's tube can also be heated before ignition, in this context, to enhance longevity of the lamp. At block 220, the electrodes are driven/ignited and optionally powered at a boost level to inject a boost, or high, level of electrons through a tube (between electrodes). Where this boost level is implemented, it may be initiated at different points in the process as shown, to suit particular applications. At block 230, the auxiliary filament is throttled in response to the auxiliary filament and/or an auxiliary amalgam reaching a threshold temperature level corresponding to the release of mercury from the auxiliary amalgam. This throttling may be set, for example, to occur at a pre-set time at which the auxiliary amalgam is expected to have heated to (or beyond) a threshold level at which it releases mercury. This throttling may also be responsive to a detected condition such as temperature, of the operating lamp.

At block 240, the heating of the auxiliary filament is terminated, when a release of mercury from a main amalgam is sufficient. This termination may correspond, for example, to a main electrode discharge current which generates sufficient light with a main amalgam, at a nominal operational drive current and/or at a boost current level (e.g., about 1.5 times a nominal current level for normal lamp operation). In many applications, this start-up time is about 30 seconds, after which the auxiliary filament is no longer driven. In some implementations, this time is kept shorter than the total time it takes for the lamp circuit to reach its final operating temperature (e.g., 3-5 minutes) to ensure that there will be mercury in the auxiliary amalgam close to the heater filament for a subsequent cycle, even if the lamp was switched on for as short as one minute. As the auxiliary amalgam cools, it reabsorbs mercury at block 260, after dropping below a threshold temperature at which the auxiliary amalgam releases mercury. Where a boost current is applied to the discharge current that is floating between main electrodes, this boost current is terminated at block 250 at an appropriate time, such as may be controlled based upon a light output (e.g., about 3 minutes). At block 270, the main electrode continues to operate for normal operating conditions, under which it injects current through the tube for generating light via mercury excitation in the tube.

Figure 3:
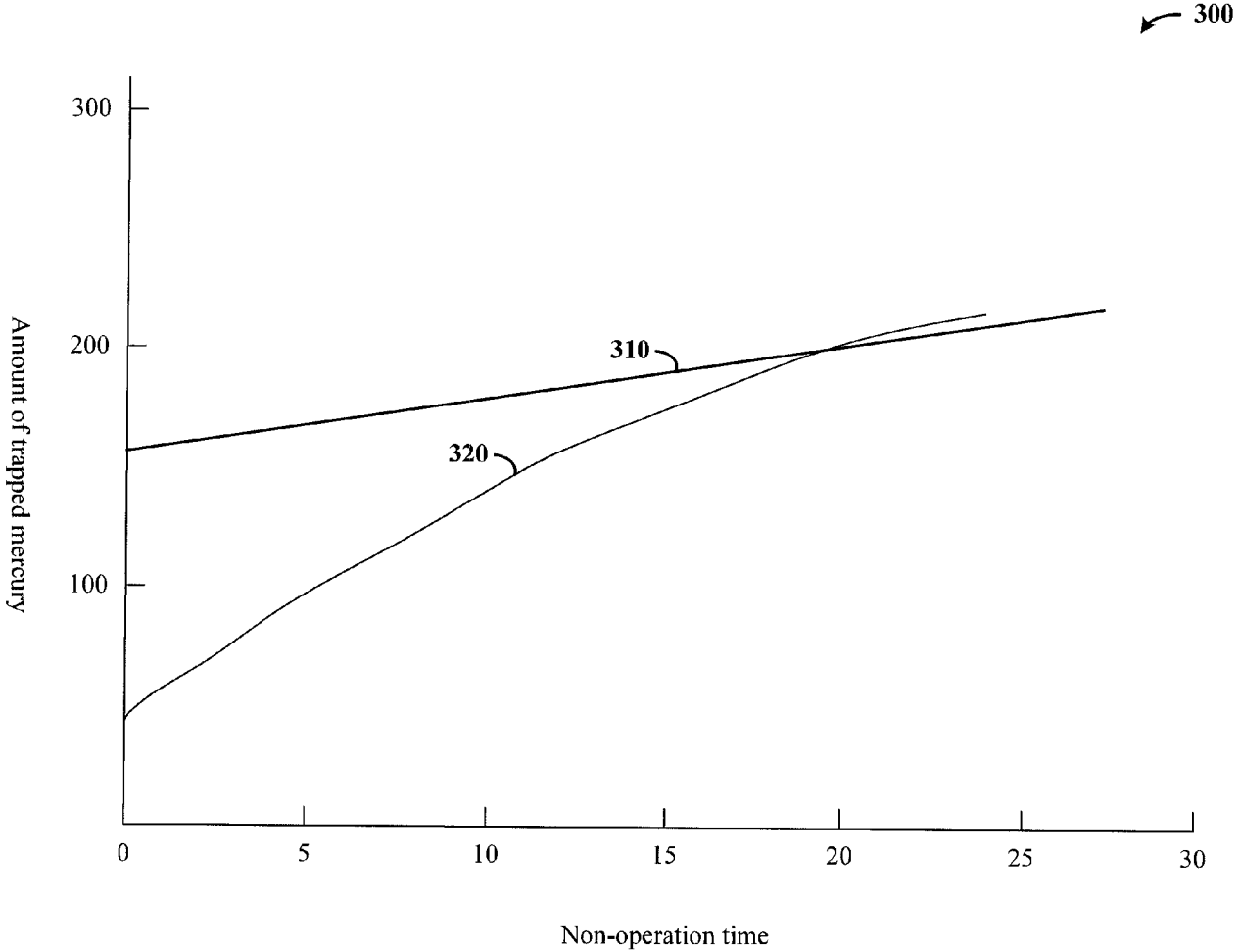
FIG. 3 is a plot showing trapped mercury in an amalgam material, in accordance with another example embodiment of the present invention.

FIG. 3 is a plot showing trapped mercury in an amalgam material, in accordance with another example embodiment of the present invention. The horizontal axis represents non-operation time, which may relate to time since a previous turn-on of a lamp as discussed herein. The vertical axis represents an amount of mercury trapped in an amalgam material. Plot 310 shows an amount of mercury stored in an auxiliary amalgam material operated in accordance with one or more embodiments herein, in which the temperature of the auxiliary amalgam is controlled so that the auxiliary amalgam absorbs mercury during normal operation of a lamp (e.g., after the auxiliary amalgam is used for a start-up period to provide additional mercury for lighting). Plot 320 is shown by way of example as a comparison of mercury reabsorbed in an amalgam, such as an auxiliary amalgam located near discharge electrodes, which is not operated to re-absorb mercury during operation of a lamp as with the auxiliary amalgam discussed above.

Figure 4A:
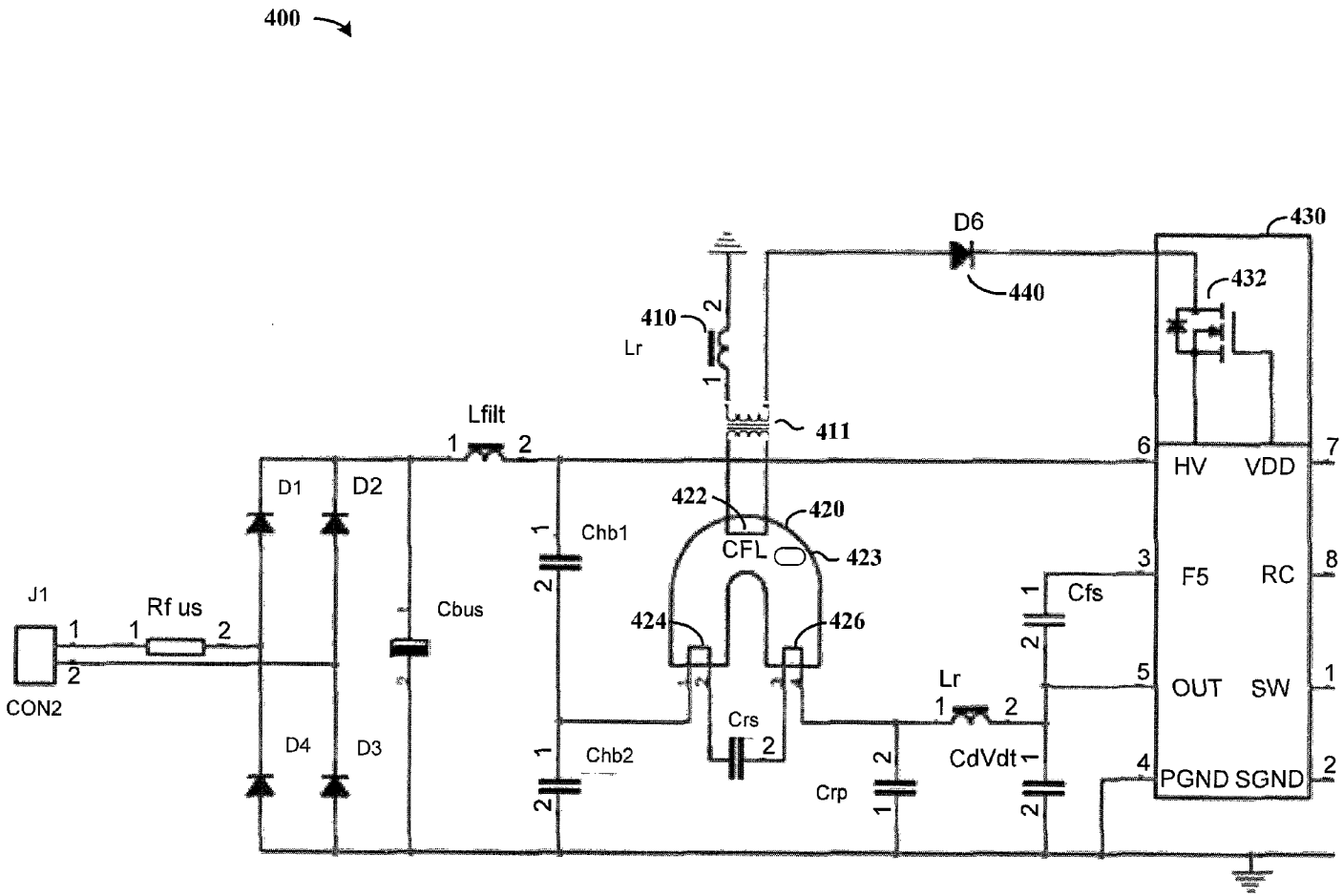
FIGS. 4A-4C show configurations of a lamp circuit with an auxiliary amalgam, according to another example embodiment of the present invention.
Figure 4B:
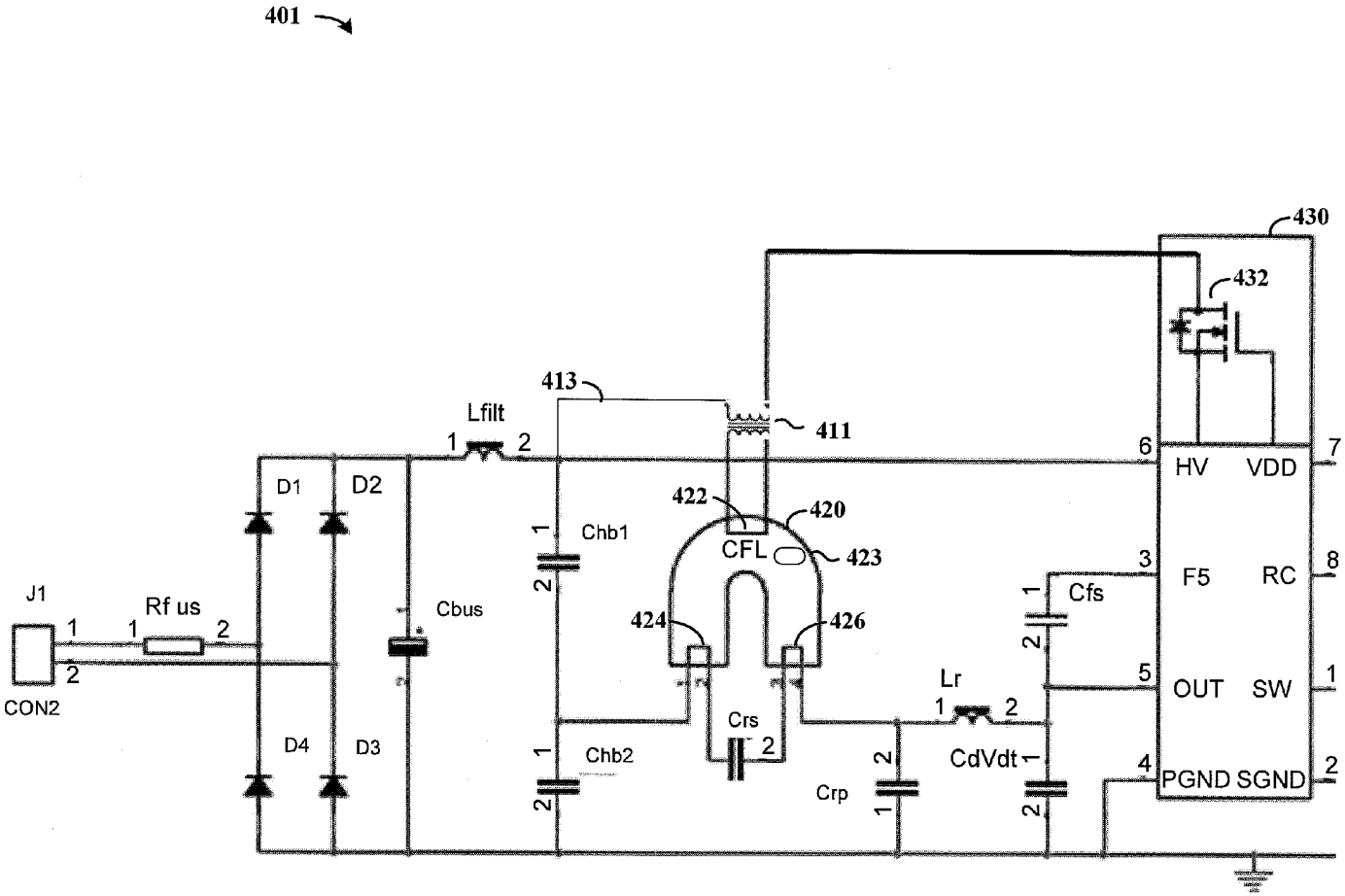
Figure 4C:
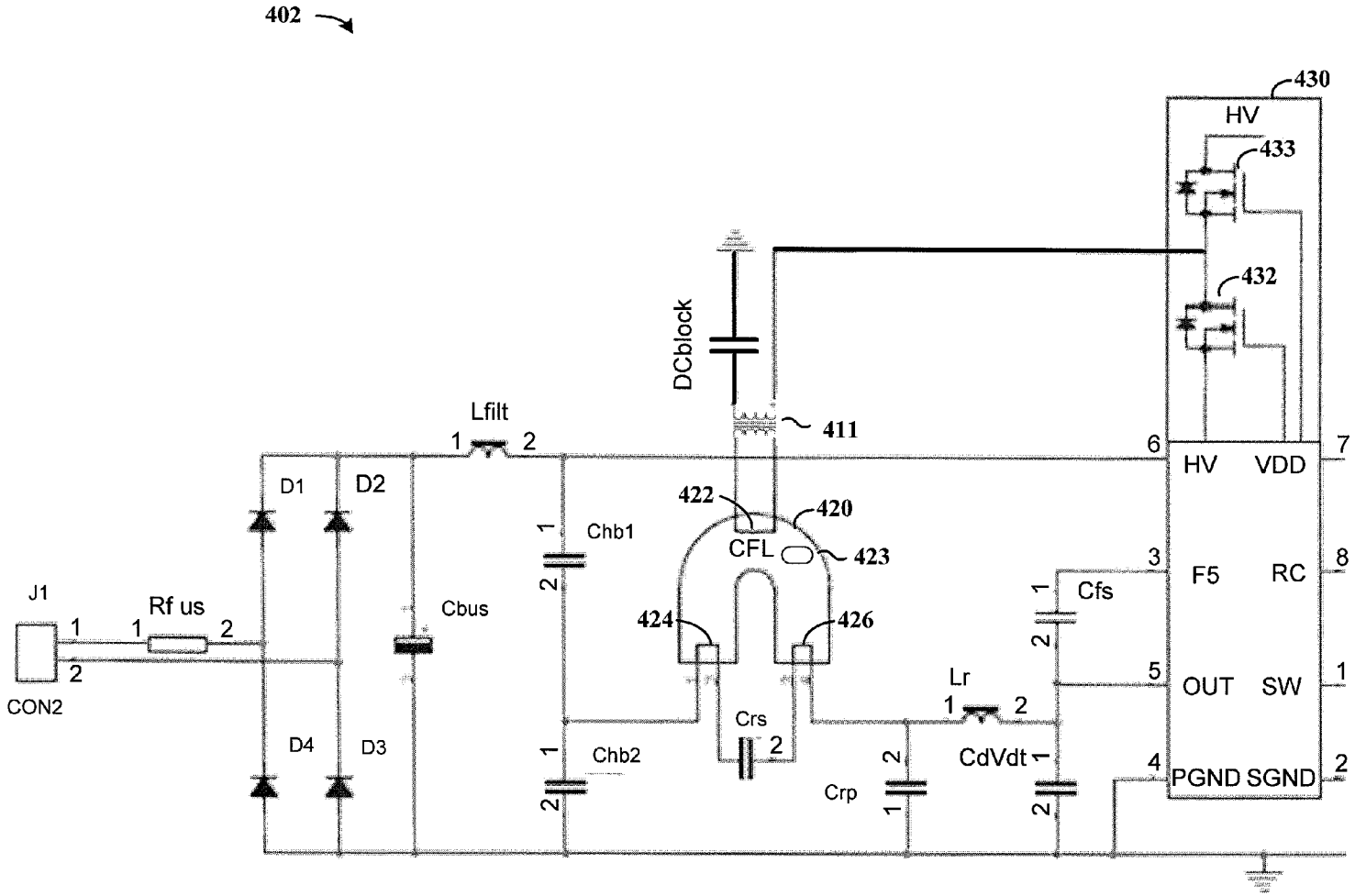

FIG. 4 shows configurations in FIGS. 4A, 4B and 4C, of a lamp 400 with an auxiliary amalgam, according to another example embodiment of the present invention. Beginning with FIG. 4A (and as applicable to FIG. 4B and FIG. C), the lamp 400 includes an auxiliary winding 410 that is driven using a controller 430 to heat an auxiliary amalgam in a compact fluorescent tube 420. In some implementations, the controller 430 is programmed or otherwise receives control data from an external connection, such as via a pin input, such as for controlling one or more respective operational characteristics of the lamp 400. The winding 410 is fed via a diode 440 through a filament 422 into a pin on the controller 430, with the diode accommodating a FET 432 that is connected to ground (the FET has a body diode that cannot be switched off). A transformer 411, such as a small toroid current transformer, is between the winding 410 and the diode 440. The tube 420 also includes main electrodes 412 and 414, which are driven to pass current in the tube for generating light. In various embodiments, the lamp 400 includes a discharge loop that measures and controls discharge current in the tube 420 (e.g., as may be implemented in the patent documents referenced herein).

In some implementations, the controller 430 is configured to use pulse-width modulation to control the FET 432, and to correspondingly control the current through the filament 412 and therein regulate the temperature of the filament. This regulation may be carried out, for example, to control different heating stages of the tube 420, such as described herein.

In one embodiment, the controller 430 controls the heating of the filament 412, and correspondingly the heating of an auxiliary amalgam (e.g., 423, shown positioned by way of example), as follows. During the first second in a start-up condition of the lamp 400, the FET is controlled to conduct all of the time in order to apply a high current to the filament 412 and rapidly heat an auxiliary amalgam. From the time period between 1 and 30 seconds, the FET is controlled (e.g., throttled) such that it conducts about 15% of the time, to keep the filament 412 at a desired temperature to maintain the auxiliary amalgam at a temperature that is high enough to cause the release of mercury into the tube 410. The operation of the FET 432 during this period (1-30 seconds) can be varied, depending upon the application conditions (e.g., tube size, amalgam composition, component positioning and others), to achieve the functional result of the maintained release of mercury, while not necessarily heating the filament 412 to a level that is much higher than required to do so (e.g., within about 100K of a threshold temperature as which an auxiliary amalgam releases mercury). After 30 seconds have passed since start-up, the control circuit controls the FET 432 in an off state.

FIG. 4B shows an embodiment in which 401, similar to lamp 400 in FIG. 4A, includes a flyback circuit arrangement in which transformer 411 has its primary side connected between pin HV and the FET 432, and its secondary side connected to filament 422. In these embodiments, the winding 410 and diode 440 can be omitted, with the transformer 411 connected via conductor 413. The controller 430 drives the transformer 411 with a duty cycle that is modulated (e.g., to send 100%, 20% or no power into the filament 422).

FIG. 4C shows a resonant embodiment involving lamp 402, similar to lamp 400 in FIG. 4A. The lamp 402 includes another FET 433. This FET 433 is connected directly to the transformer 411 at a common node with the FET 432. Relative to FIG. 4A, lamp 402 omits diode 440 and winding 410.

In other embodiments, the controller 430 and/or additional circuits in the lamp 400, 401 or 402 are configured to control the respective time periods for start-up and normal operation, and where applicable, for an initial rapid heating portion of a start-up period (e.g., as with the initial one second period discussed above). One or more additional pins may be implemented on the controller 430, along with resistors and/or capacitors related to this control, for carrying out functions such as setting an initial on time, a duty cycle during a throttling type period, and total on time. In addition and as consistent with the above, the controller 430 may be configured to receive external inputs, such as from another circuit controller, logic circuit or computer, and to use the inputs to set one or more operational characteristics of the lamp 400. In yet another embodiment the controller contains flash memory programmed at the production of the lamp to control timing aspects.

The auxiliary filament 423 can be placed in a variety of locations and with a variety of different shaped tubes. In some implementations, the auxiliary filament 423 is placed between filaments 424 and 426, or in an end of a T-shaped or L-shaped bulb. In various implementations, the distance between an electrode used for discharge current (e.g., for illumination using released mercury) and the auxiliary filament used for heating the auxiliary amalgam are set far enough from each other to permit the control of the heating of the auxiliary amalgam as discussed herein. In these contexts, the shape of the tube 420 is shown by way of example.

In some embodiments, the controller 430 includes a timing circuit such as a timing capacitor that sets the heating time, or another circuit that sets the heating time of the auxiliary filament 423 (e.g., to increase the time if the lamp 400 was last switched off within a short time period, such as within 30 or 60 minutes from a subsequent start-up).

Figure 5:
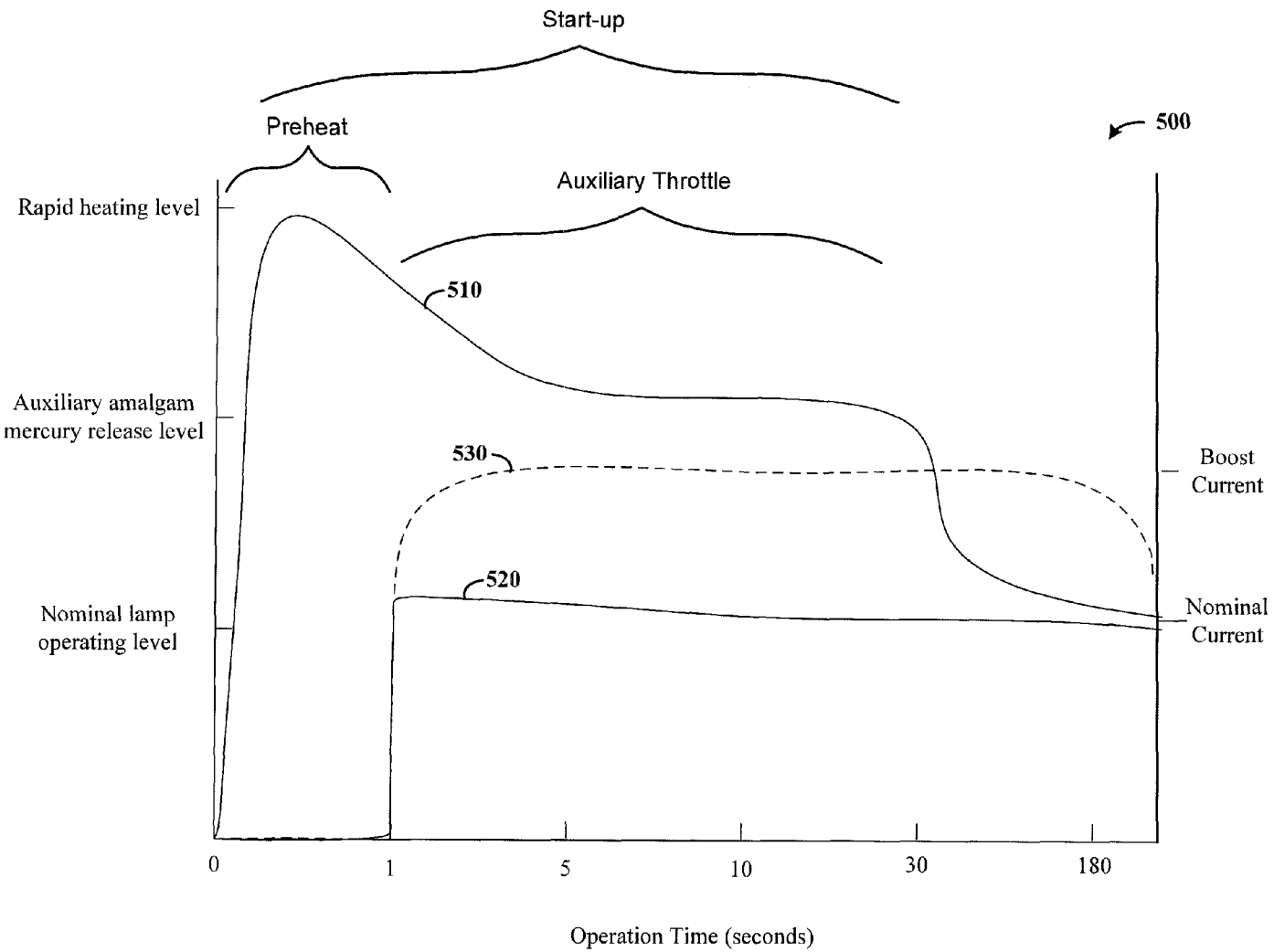
FIG. 5 shows a plot characterizing the operation of a lamp and the temperature around an auxiliary amalgam, in accordance with another example embodiment of the present invention.

FIG. 5 shows plots characterizing the operation of a lamp, in accordance with another example embodiment of the present invention. Time is shown on the horizontal axis (not to scale), and an operating level, generally corresponding to temperature and current as applied to filaments/electrodes, is respectively shown on the left and right vertical axis. The actual temperatures and related current levels may vary depending upon the particular application, as may the represented timing, with the relative plots maintained accordingly.

Plot 510 represents operation of an auxiliary filament used to heat an auxiliary amalgam that releases mercury at temperatures well above a nominal operational temperature of a lamp, and absorbs mercury at temperatures nearer the nominal operational temperature. Plot 520 represents operation of main electrodes used to generate current for exciting mercury (and generating light), and to heat a main amalgam used to release mercury at the nominal operating temperature. Plot 530 represents the control of the main electrodes during an optional boost period, during which a boost level of current is passed between main electrodes. The approaches shown in FIG. 5 may, for example, be implemented with a lamp as shown in FIG. 1.

During an initial pre-heat stage (e.g., 0-0.5 s, or 0-1 s), the auxiliary filament is heated to a rapid heating temperature, and a main electrode is also preheated. After the pre-heat stage, the lamp is operated to pass current through the bulb. The drive of the auxiliary filament is throttled to make it reach a temperature that exceeds a mercury release temperature for the auxiliary filament, yet is held relatively close to this temperature (e.g., to conserve energy and/or lifetime). After the throttle period (e.g., about 30 seconds), the auxiliary filament is turned off and the auxiliary amalgam is allowed to cool below its mercury release temperature, and absorb mercury for use in a subsequent start-up. During these periods, the main amalgam is operated at the nominal lamp temperature (e.g., a balance of the power put into the lamp via the discharge current times the voltage, the power that leaves the lamp as light and the heat that is lost to the environment of the lamp). The lamp continues to operate via the generation of light from mercury released from a main amalgam.

Where a boost is used, and referring to plot 530, the main electrodes are driven at a high current level, which results in a boost level of current flowing through the tube. This boost level may be maintained, for example, to a time of about three minutes (180 seconds) after initial start-up. After this time, the main electrodes are driven at a nominal current level for normal lamp operation.

Based upon the above discussion and illustrations, those skilled in the art will readily recognize that various modifications and changes may be made to the present invention without strictly following the exemplary embodiments and applications illustrated and described herein. For example, different types fluorescent or other lamps may be driven using circuits as discussed herein. Such modifications do not depart from the true spirit and scope of the present invention, including that set forth in the following claims.

What is claimed is:

1. A lamp circuit comprising:

a heating circuit configured to heat an auxiliary amalgam-based material in a tube containing the auxiliary amalgam-based material and a main amalgam-based material; and a driver circuit configured to during a start-up period, control the heating circuit to heat the auxiliary amalgam-based material to an elevated temperature at which the auxiliary amalgam-based material releases mercury, and after the start-up period, control the heating circuit to lower the temperature of the auxiliary amalgam-based material to a temperature at which the auxiliary amalgam-based material absorbs mercury, while the main amalgam-based material is heated to a lamp operating temperature at which the main amalgam-based material releases mercury; and wherein the driver circuit is further configured to control the heating circuit to heat the auxiliary amalgam-based material to an elevated temperature at which the auxiliary amalgam-based material releases mercury by during an initial rapid heating portion of the start-up period, driving the heating circuit to a temperature that is above the temperature at which the auxiliary amalgam-based material releases mercury, and after the rapid heating period, driving the heating circuit to a reduced temperature to maintain the auxiliary amalgam-based material at a temperature that is at least as high as the elevated temperature.

2. A lamp circuit comprising:

a heating circuit configured to heat an auxiliary amalgam-based material in a tube containing the auxiliary amalgam-based material and a main amalgam-based material; and a driver circuit configured to during a start-up period, control the heating circuit to heat the auxiliary amalgam-based material to an elevated temperature at which the auxiliary amalgam-based material releases mercury, and after the start-up period, control the heating circuit to lower the temperature of the auxiliary amalgam based material to a temperature at which the auxiliary amalgam-based material absorbs mercury, while the main amalgam-based material is heated to a lamp operating temperature at which the main amalgam-based material releases mercury; and further including main electrodes configured to emit electrons for passing through the tube, to heat the main amalgam-based material and to interact with the released mercury to generate light, and wherein the driver circuit is configured to drive the main electrodes for emitting electrons through the tube and heating the main amalgam by during a boost period including at least a portion of the start-up period, driving the main electrodes at a boost current level at which the electrodes emit a high number of electrons through the tube, and after the boost period, driving the main electrodes at a low-current level at which the electrodes emit fewer electrons through the tube, relative to electrons emitted at the boost current level.

3. A lamp circuit comprising:

a heating filament;

two electrode filaments;

a main amalgam-based material that releases mercury at a lamp operating temperature;

an auxiliary amalgam-based material that releases mercury at an elevated temperature that is above the lamp operating temperature, and that absorbs mercury at temperatures below the elevated temperature; and a driver circuit configured to drive the electrode filaments to heat the lamp circuit and the main amalgam-based material to the lamp operating temperature and to emit electrons for passing between the electrode filaments and generating light, and during a start-up period, drive the heating filament to heat the auxiliary amalgam-based material to the elevated temperature to cause the auxiliary amalgam-based material to release mercury; and wherein the driver circuit is configured to drive the heating filament in response to a control input received on an input pin from an external logic circuit.

4. The circuit of claim 3, wherein the driver circuit is configured to, after the start-up period, stop driving the heating filament to cause the auxiliary amalgam-based material to absorb mercury, and drive the electrode filaments to emit electrons to generate light from the released mercury and to heat the lamp circuit and main amalgam-based material to the lamp operating temperature.

5. The circuit of claim 3, further including another auxiliary amalgam-based material that is configured to release mercury at the lamp operating temperature.

6. The circuit of claim 3, wherein the driver circuit includes an auxiliary driver that drives the heating filament and a main ballast driver that drives the electrode filaments.

7. The circuit of claim 3, wherein the driver circuit is configured to drive the electrode filaments at a boost current level during a boost period including at least a portion of the start-up period, and after the boost period, drive the electrode filaments at a lamp operating current level that is below the boost current level.

8. The circuit of claim 3, further including a bulb that encloses the main and auxiliary amalgam-based materials, and configured to contain mercury released by the main and auxiliary amalgam-based materials, for generating light via the interaction of current passed between the filaments emitted with the released mercury.

9. A lamp circuit comprising:

a heating filament;

two electrode filaments;

a main amalgam-based material that releases mercury at a lamp operating temperature;

an auxiliary amalgam-based material that releases mercury at an elevated temperature that is above the lamp operating temperature, and that absorbs mercury at temperatures below the elevated temperature; and a driver circuit configured to drive the electrode filaments to heat the lamp circuit and the main amalgam-based material to the lamp operating temperature and to emit electrons for passing between the electrode filaments and generating light, and during a start-up period, drive the heating filament to heat the auxiliary amalgam-based material to the elevated temperature to cause the auxiliary amalgam-based material to release mercury; and wherein the driver circuit is further configured to drive the heating filament to heat the auxiliary amalgam-based material to the elevated temperature during the start-up period by during a rapid heating portion of the start-up period, driving the heating filament to a rapid heating temperature that exceeds the elevated temperature, and after the rapid heating portion of the start-up period, driving the heating filament to a temperature that is lower than the rapid heating temperature to maintain the auxiliary amalgam-based material at a temperature that is at least as high as the elevated temperature.

10. The circuit of claim 9, wherein the driver circuit is configured to drive the heating filament to heat the auxiliary amalgam-based material to the elevated temperature during the start-up period by during the rapid heating portion of the start-up period, driving the heating filament to a rapid heating temperature that exceeds the elevated temperature by at least about 200 K, and after the rapid heating portion of the start-up period, driving the heating filament to a temperature that is at least 100K lower than the rapid heating temperature to maintain the auxiliary amalgam-based material at a temperature that is at least as high as the elevated temperature.

11. A lamp circuit comprising:

a heating filament;

two electrode filaments;

a main amalgam-based material that releases mercury at a lamp operating temperature;

an auxiliary amalgam-based material that releases mercury at an elevated temperature that is above the lamp operating temperature, and that absorbs mercury at temperatures below the elevated temperature; and a driver circuit configured to drive the electrode filaments to heat the lamp circuit and the main amalgam-based material to the lamp operating temperature and to emit electrons for passing between the electrode filaments and generating light, and during a start-up period, drive the heating filament to heat the auxiliary amalgam-based material to the elevated temperature to cause the auxiliary amalgam-based material to release mercury; and wherein the driver circuit is configured to drive the heating filament to heat the auxiliary amalgam-based material to the elevated temperature during the start-up period by during a rapid heating portion of the start-up period, driving the heating filament to a rapid heating temperature that exceeds the elevated temperature at which the auxiliary amalgam-based material releases mercury, and after the rapid heating portion of the start-up period, using a modified duty cycle to drive the heating filament to a temperature that is lower than the rapid heating temperature to maintain the auxiliary amalgam-based material at a temperature that is at least as high as the elevated temperature.

12. A method for operating a lamp circuit, the method comprising:

during a start-up period, driving a heating filament to heat an auxiliary amalgam-based material to an elevated temperature at which the auxiliary amalgam-based material releases mercury into a tube containing the auxiliary amalgam-based material and a main amalgam-based material, and after the start-up period, driving the heating filament to permit the auxiliary amalgam-based material to drop to a temperature at which the auxiliary amalgam-based material absorbs mercury, while the main amalgam-based material is heated to a lamp operating temperature at which the main amalgam-based material releases mercury, and wherein driving a heating filament to heat an auxiliary amalgam-based material to an elevated temperature includes during an initial rapid heating portion of the start-up period, driving the heating filament to a temperature that is above the temperature at which the auxiliary amalgam-based material releases mercury, and after the rapid heating period, driving the heating filament to a reduced temperature to maintain the auxiliary amalgam-based material at a temperature that is at least as high as the elevated temperature.

13. The method of claim 12, further including driving electrode filaments to emit electrons for passing current in the tube to heat the tube and the main amalgam-based material to the lamp operating temperature, and to generate light from mercury released in the tube.

14. The method of claim 12, wherein driving the heating filament to permit the auxiliary amalgam-based material to drop to a temperature at which the auxiliary amalgam-based material absorbs mercury includes turning the heating filament off while driving electrode filaments to emit electrons for passing current through the tube to heat the tube and the main amalgam-based material to the lamp operating temperature, and to generate light from released mercury in the tube.

15. A method for operating a lamp circuit, the method comprising:

during a start-up period, driving a heating filament to heat an auxiliary amalgam-based material to an elevated temperature at which the auxiliary amalgam-based material releases mercury into a tube containing the auxiliary amalgam-based material and a main amalgam-based material, and after the start-up period, driving the heating filament to permit the auxiliary amalgam-based material to drop to a temperature at which the auxiliary amalgam-based material absorbs mercury, while the main amalgam-based material is heated to a lamp operating temperature at which the main amalgam-based material releases mercury, and during a boost period, driving electrode filaments at a boost current level at which the electrode filaments pass a high current through the tube for generating light from the released mercury, and after the boost period, driving the electrode filaments at a low-current level at which the electrode filaments pass a relatively lower current through the tube, relative to the high current.

* * * * *